US005993139A

United States Patent [19]

Deneve et al.

[11] Patent Number: 5,993,139

[45] **Date of Patent: *Nov. 30, 1999**

[54] BOX BOOM LIFT ARM ASSEMBLY

[75] Inventors: Jeffrey A. Deneve; Owen S. Loughrin; Charles T. McMillan, all of Sanford, N.C.

[73] Assignee: Caterpillar Inc., Peoria, Ill.

[ * ] Notice: This patent is subject to a terminal disclaimer.

[21] Appl. No.: 09/048,249

[22] Filed: Mar. 25, 1998

Related U.S. Application Data

[60] Provisional application No. 60/051,316, Jun. 30, 1997.

[51] Int. Cl.[6] ..... B66C 23/00

[52] U.S. Cl. ..... 414/722; 414/697

[58] Field of Search ..... 414/722, 697, 414/700–715; 212/347; 52/111, 116, 632, 731.2, 731.6, 732.1, 735.1; 29/897.2, 897.31; 228/165, 166, 667, 174, 182

[56] References Cited

U.S. PATENT DOCUMENTS

| | | | |
|---|---|---|---|
| 3,589,539 | 6/1971 | Witwer . | |
| 3,648,871 | 3/1972 | Layton . | |
| 3,890,696 | 6/1975 | Buske | 228/173 |
| 3,902,295 | 9/1975 | Yancey | 52/730 |
| 4,034,876 | 7/1977 | Yancey . | |
| 4,069,637 | 1/1978 | Braithwaite | 52/726 |
| 4,153,167 | 5/1979 | Gill | 214/138 R |
| 4,275,542 | 6/1981 | Moro et al. | 52/731 |
| 4,392,314 | 7/1983 | Albrecht et al. | 37/103 |
| 4,428,173 | 1/1984 | Knell | 52/731 |
| 4,768,917 | 9/1988 | Garman | 414/697 |
| 4,776,750 | 10/1988 | Griswold et al. | 414/698 |
| 5,125,787 | 6/1992 | Ball et al. | 414/722 |
| 5,152,659 | 10/1992 | Waka | 414/722 |
| 5,400,531 | 3/1995 | Brown | 37/468 |
| 5,595,471 | 1/1997 | Ajilore | 414/685 |
| 5,599,158 | 2/1997 | Ajilore | 414/685 |

FOREIGN PATENT DOCUMENTS

| | | | |
|---|---|---|---|
| 962233 | 2/1975 | Canada . | |
| 0791693 | 8/1997 | European Pat. Off. . | |
| 1410683 | 12/1965 | France . | |
| 2418840 | 9/1979 | France | E02F 3/04 |
| 1456538 | 4/1969 | Germany . | |
| 3-180628 | 8/1991 | Japan | E02F 9/14 |
| WO8102884 | 10/1981 | WIPO . | |

OTHER PUBLICATIONS

Patent Abstracts of Japan; Publication No. 58062226 dated Apr. 13, 1983 Application Date Oct. 5, 1981; Application No. 56159034.

*Primary Examiner*—Donald W. Underwood
*Attorney, Agent, or Firm*—Diana L. Charlton

[57] ABSTRACT

The box boom lift arm assembly of the present invention includes a single plate steel top wall and a bottom wall connected with a substantially non-transverse weld to a pair of single plate steel inner side walls and a pair of single plate steel outer side walls to define a closed box section having a rectangular cross section along the entire length, varying only in height and width. The unique configuration and shape of the plates and the use of non-transverse weld during manufacturing improve the fatigue characteristics, load distribution and strength of the box boom lift arm assembly without increasing the weight of the machine.

12 Claims, 6 Drawing Sheets

BOX BOOM LIFT ARM ASSEMBLY

CROSS REFERENCE TO RELATED APPLICATIONS

This application is based, in part, on the material disclosed in United States provisional patent application Ser. No. 60/051316 filed Jun. 30, 1997.

TECHNICAL FIELD

This invention relates generally to load carrying structures generally having a rectangular box-like section and more particularly to a box boom lift arm of a wheel loader which encounters side, torsional, bending and axial loading.

BACKGROUND ART

Present construction machines, such as wheel loaders, typically include load carrying structures, such as slab lift arms, or occasionally, a box boom lift arm, which is mounted to a frame of the machine by various connection means. The box boom lift arm is generally a hollow unitary structure made from one or more castings connected by a transversely welded midsection.

During operation of the wheel loader, it is quite common for the box boom lift arm assembly to experience a high degree of loading, some of which may be severe. Therefore, it is desirable to carry and distribute loads exerted on the box boom lift arm assembly to minimize failure of the structural elements. For improved machine performance, it is also desirable to minimize the weight of the box boom lift arm assembly while maintaining the high strength capabilities. Furthermore, it is desirable to simplify the box boom lift arm assembly manufacturing and welding processes.

Constructions of, and methods for, making load carrying structures are disclosed in the following patents. U.S. Pat. No. 3,902,295 issued to John W. Yancy on Sep. 2, 1975 and U.S. Pat. No. 4,428,173 issued to Harvey A. Knell on Jan. 31, 1984 show details of booms used on excavators. U.S. Pat. No. 4,768,917 issued to Anthony L. Garman on Sep. 6, 1988 and U.S. Pat. No. 5,152,659 issued to Toshihiko Waka on Oct. 6, 1992 show details of booms for loader type machines. In the design shown in U.S. Pat. No. 4,768,917, the boom arm is made from two hollow end castings welded together by a welded midsection. Loads on the boom arm will be experienced at the transverse welded midsection of the boom arm which may reduce overall component life. In the design shown in U.S. Pat. No. 5,152,659, the boom assembly comprises a pair of boom arms which are formed with a plurality of welded, overlapping C-channels. The overlapping of the C-channels increases the weight of the machine and complicates the welding process.

The present invention is directed to overcoming the problems as set forth above.

DISCLOSURE OF THE INVENTION

In one aspect of the present invention, a box boom lift arm assembly for a construction machine has top and bottom walls which extend a predetermined length. The top and bottom walls each have a central portion with a predetermined width, a first end portion which diverges outwardly from the central portion and terminates at a predetermined width greater than the predetermined width of the central portion and a bifurcated second end portion which diverges outwardly in a substantial U-shape from the central portion opposite the first end portion and terminates at a predetermined width greater than the predetermined width of the central portion. A pair of inner side walls have a predetermined length substantially equal to the length of the top and bottom walls. The pair of inner side walls each have first and second ends and are disposed between the top and bottom walls and fixedly connected thereto substantially along the entire predetermined length of the inner side walls. The first ends of the inner side walls define with the first end portions of the top and bottom walls, a diverging end portion. A pair of outer side walls have a predetermined length. The pair of outer side walls each have first and second ends and are fixedly connected at the first end to one of the pair of inner side walls at a predetermined location along the predetermined length of the inner side wall and are disposed between the U-shape second end portion of the top and bottom walls and fixedly connected thereto. The second ends of the outer side walls define with the second ends of the inner side walls and the second end portions of the top and bottom walls, a bifurcated end portion having a pair of legs.

The present invention includes a box boom lift arm assembly with top and bottom walls fixedly connected to a pair of inner and outer side walls substantially along a predetermined length of the respective inner and outer side walls. The unique structure and connection of the top and bottom walls to the pair of inner and outer side walls improves the fatigue characteristics, load distribution and strength of the box boom lift arm assembly without increasing the weight of the machine.

BEST MODE FOR CARRYING OUT THE INVENTION

Figure 1:
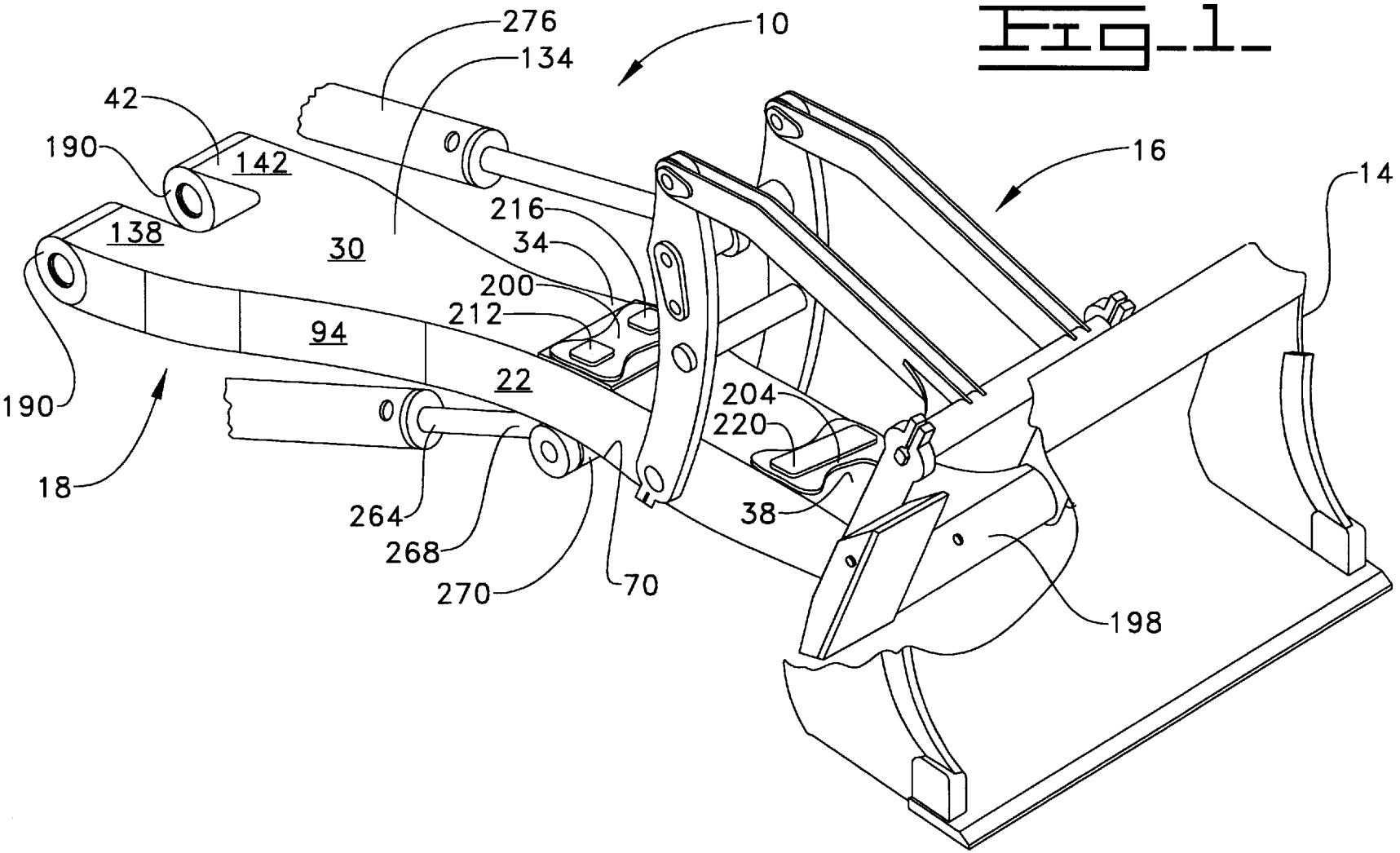
FIG. 1 is a diagrammatic isometric view showing an embodiment of the present invention represented in a typical environment on a wheel loader.

While the invention is susceptible to various modifications and alternative forms, a specific embodiment thereof has been shown by way of example in the drawings and will herein be described in detail. It should be understood, however, that there is no intent to limit the invention to the particular form disclosed, but, on the contrary, the intention is to cover all modifications, equivalents, and alternatives falling within the spirit and scope of the invention as defined in the appended claims.

Figure 2:
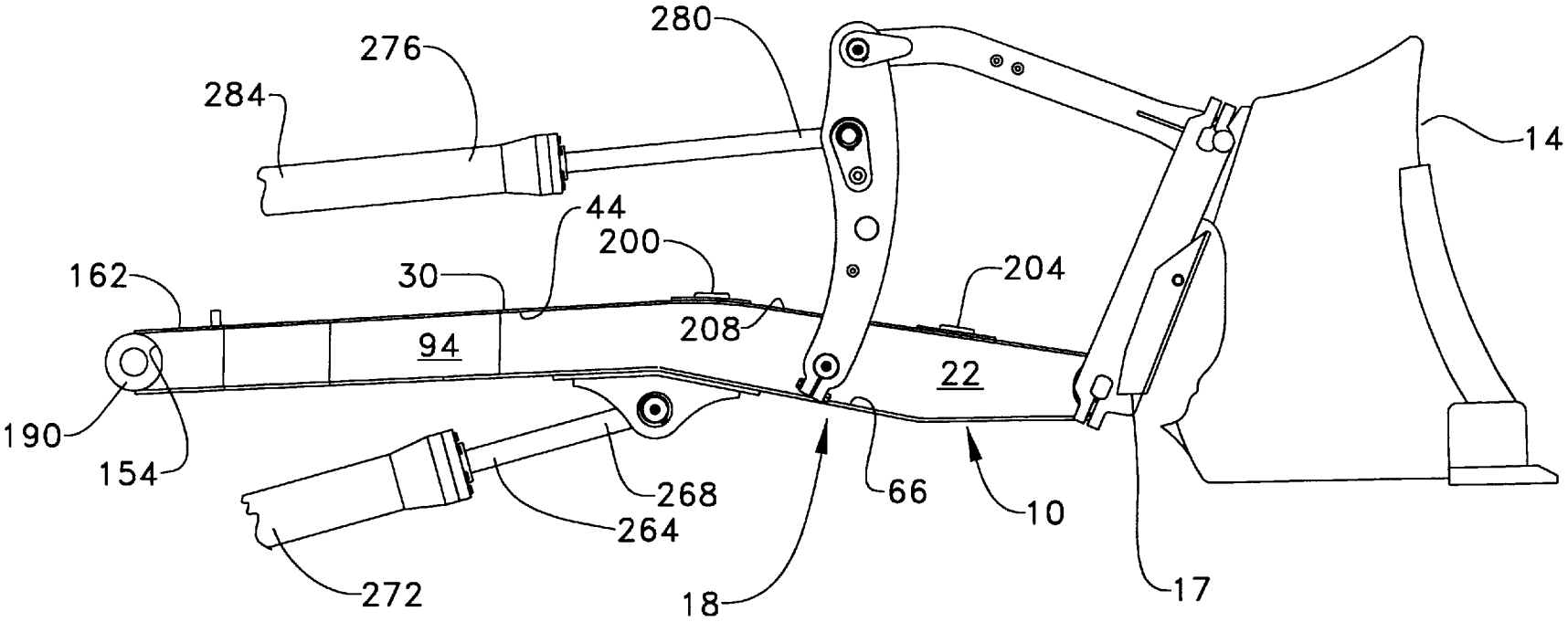
FIG. 2. is a diagrammatic side view showing the embodiment of the present invention represented in the typical environment on the wheel loader.
Figure 3:
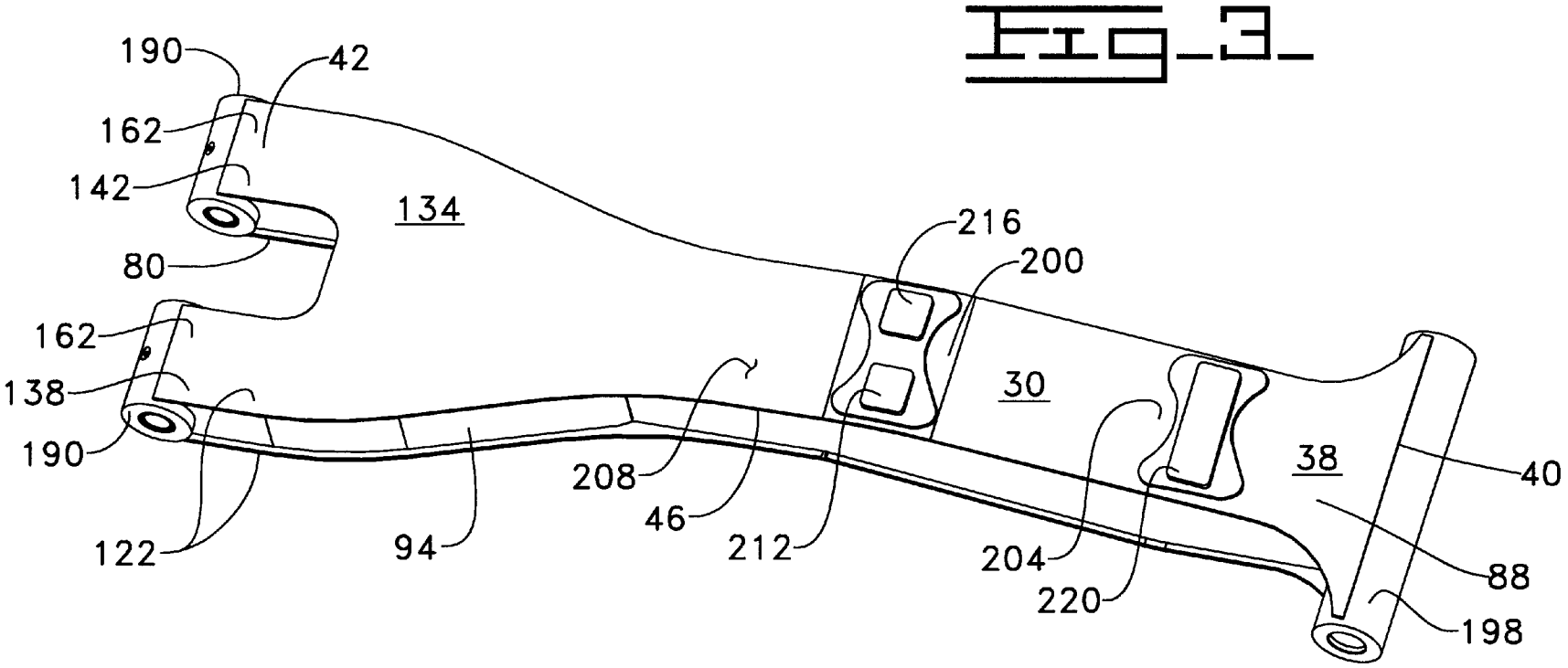
FIG. 3 is an diagrammatic isometric view of the embodiment of the present invention.
Figure 4:
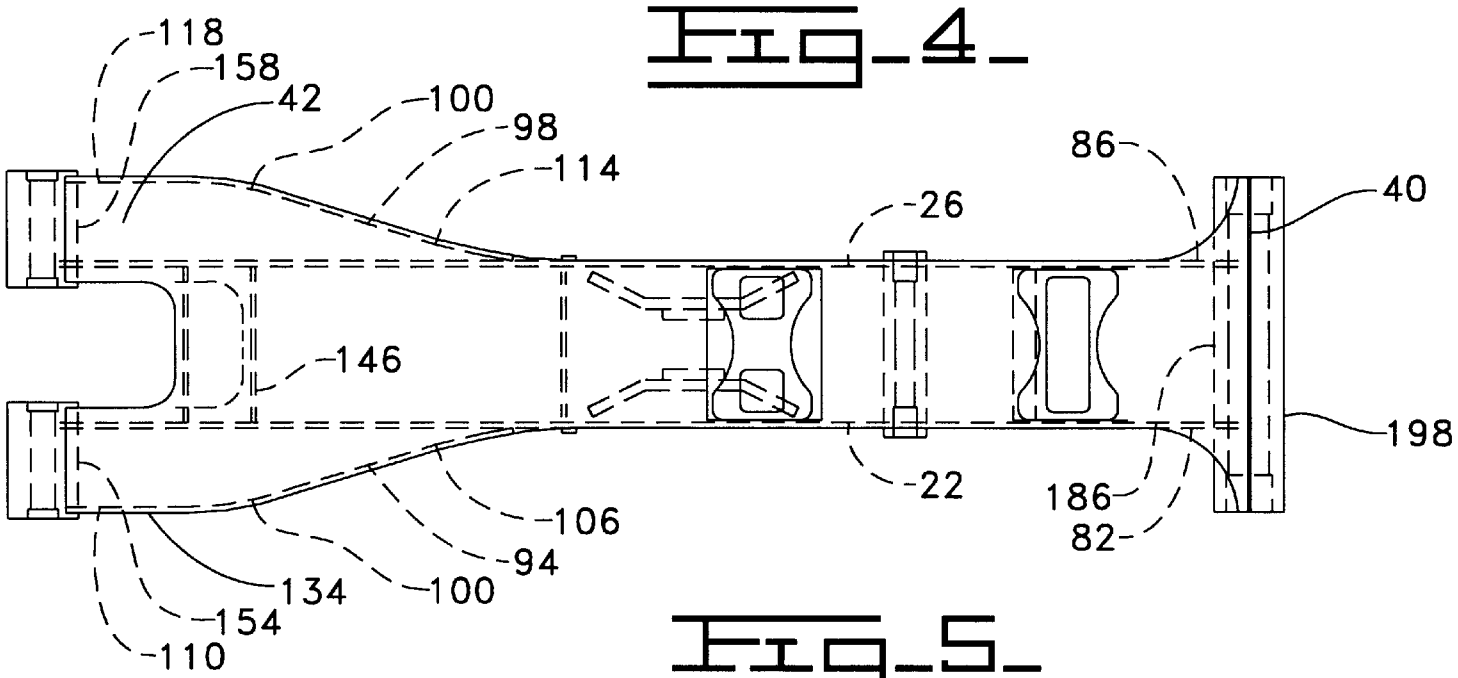
FIG. 4 is a perspective top view of the embodiment of the present invention.

Referring to the drawings, it can be seen that a box boom loader mechanism 10 for use on a construction machine (not shown), such as a wheel loader, is disclosed which connects a work implement 14 to a frame (not shown), such as an engine frame for a non-articulated machine or a non-engine end frame for an articulated machine, of the construction machine (not shown) in cooperation with a linkage arrangement 16 and coupler 17. It should be understood that although the work implement shown in FIGS. 1 and 2 is a bucket commonly used in conjunction with a wheel loader that any one of a number of different tools may be used. It should also be understood that the box boom loader mechanism may be used on any type of construction machine. Additionally, it should be understood that any type of linkage arrangement may be used with a coupler or without a coupler for direct connection to the implement 14.

The box boom loader mechanism 10 includes a box boom lift arm assembly 18, shown more clearly in FIGS. 3–8, that is directly positioned between the frame (not shown) and the work implement 14. The box boom lift arm assembly 18 is a closed box section welded fabrication with a rectangular cross section extending throughout its length. The box boom lift arm assembly 18 is substantially positioned on a vertical plane that is coincident with a centerline defined by the construction machine (not shown). The box boom lift arm assembly 18 has a pair of spaced inner side walls 22,26 which extend a length approximately 0.9 to 1.1 times the length of the machine wheelbase. Each inner side wall 22,26 is constructed from a single sheet of plate steel or any other suitable type of material. A top wall 30 is formed at a location 32 approximately 0.4 to 0.6 times the length of the top wall 30 and an angle of five to fifteen degrees to achieve a length approximately equal to the length of the spaced inner side walls 22,26. The top wall 30 includes a central portion 34 with a width of approximately fifteen to twenty-five percent the machine tread width. A first end portion 38 diverges outwardly in a substantial fish-tail shape from the central portion 34 and terminates at a planar edge 40 with a continuous, non-interrupted width approximately in the range of 1.8 to 2.2 times the width of the central portion 34. A bifurcated second end portion 42 is opposite the first end portion 38 and diverges outwardly from the central portion 34 in a substantial U-shape and terminates at a width approximately in the range of 2.0 to 2.3 times the width of the central portion 34. As seen more clearly in FIG. 3, the first end portion 38 and bifurcated second end portion 42 of the top wall 30 are integrally formed with the central portion 34 from a single piece of plate steel or from any other suitable type of material. The top wall 30 is fixedly connected at a bottom surface 44 to a top surface 46 defined by the pair of spaced inner side walls 22,26 through a continuous non-transverse weld substantially along the entire predetermined length of the spaced inner side walls 22,26. The non-transverse weld traverses substantially the entire boundary of the inner side walls 22,26. A bottom wall 50 consists of a first plate member 54 fixedly connected to a bifurcated second plate member 58 through a transverse weld therebetween. The first plate member 54 is formed at a location 62 approximately one-half the length of the plate member 54 and an angle of approximately five to fifteen degrees to achieve in combination with the second plate member 58 a length approximately equal to the length of the spaced inner side walls 22,26. The first and second plate members 54,58 are fixedly connected at a top surface 66 to a bottom surface 70 defined by the pair of spaced inner side walls 22,26 through a continuous non-transverse weld substantially along the entire predetermined length of the spaced inner side walls 22,26. The first member 54 and the bifurcated second member 58 define a central portion 74, a first end portion 78 and a bifurcated second end portion 80 of the bottom wall 50 with widths and structure corresponding to the respective central portion 34, first end portion 38 and bifurcated second end portion 42 of the top wall 30 and positioned in a spaced relation therewith as defined by the pair of inner side walls 22,26. The connection of the first end portions 38,78 of the top wall 30 and first member 54 of the bottom wall 50 with a first end 82,86 of each of the pair of inner side walls 22,26, respectively, define a coupler end portion 88. A pair of outer side walls 94,98 are constructed from a single piece of plate steel or any other suitable material and each have a length of approximately 0.2 to 0.4 times the length of the top wall 30. Each of the pair of outer side walls 94,98 are formed at a first location 100 to define a substantial U-shape corresponding to the U-shape of the bifurcated second end portions 42,80 of the top and bottom walls 30,50, respectively. Each of the pair of outer side walls 94,98 include first and second ends 106,110,114,118, respectively. Each of the pair of outer side walls 94,98 are disposed between an outer portion 122 of the bifurcated second end portions 42,80 of the top and bottom walls 30,50, respectively. The pair of outer side walls 94,98 are welded at the first ends 106,114 to a respective one of the pair of inner side walls 22,26. The pair of outer side walls 94,98 are fixedly connected to the outer portion 122 of the top and bottom walls 30,50 through a continuous non-transverse weld extending substantially along the length of the outer side walls 94,98. The second ends 110,118 of the pair of outer side walls 94,98 terminate in a substantial co-planar relationship with the bifurcated second ends 42,80 of the top and bottom walls 30,50, respectively, and a second end 126,130 of each of the pair of inner side walls 22,26, respectively, to define a bifurcated end portion 134 with a pair of legs 138,142 opposite the coupler end portion 88. Each of the pair of legs 138,142 of the bifurcated end portion 134 have a circumferential periphery and a width of approximately 0.5 to 0.75 times the width of the central portion 34. A closure plate 146 is positioned between the inner side wall plates 22,26 and pair of legs 138,142 near the second ends 126,130 and has a predetermined length and width substantially equal to the distance between the spaced inner side wall plates 22,26 and the distance between the spaced top and bottom wall plates 30,50, respectively. The closure plate 146 is circumferentially welded along the inner side wall plates 22,26 and between the bifurcated end portions 42,80 of the top wall plate 30 and second bottom wall plate 58 to substantially enclose the box boom lift arm assembly 18.

It should be understood that the box boom lift arm assembly 18, and particularly the configuration of the plates, can differ as is known in the art without departing from the scope of the invention.

Figure 5:
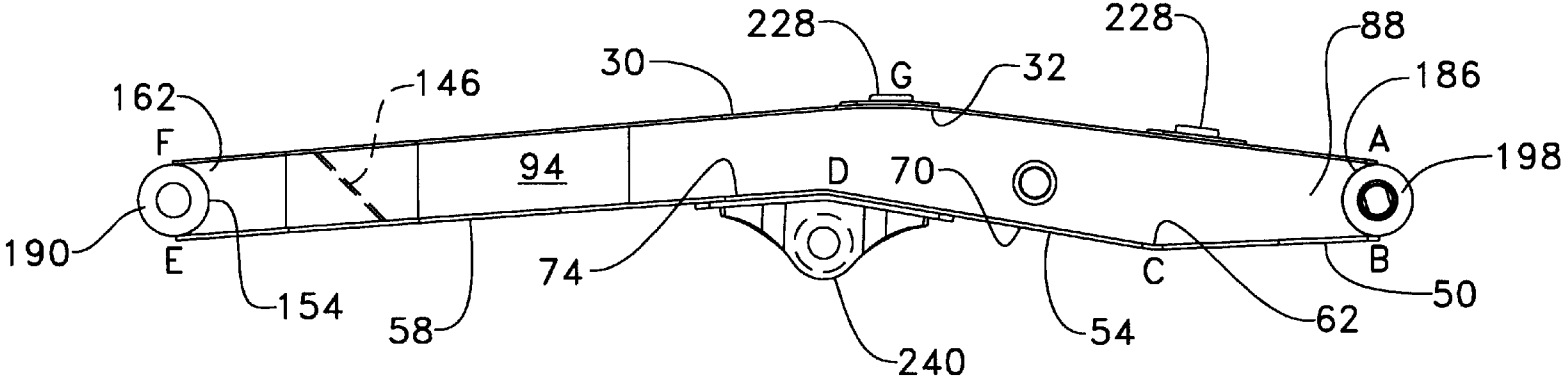
FIG. 5 is a diagrammatic side view of the embodiment of the present invention.
Figure 6:
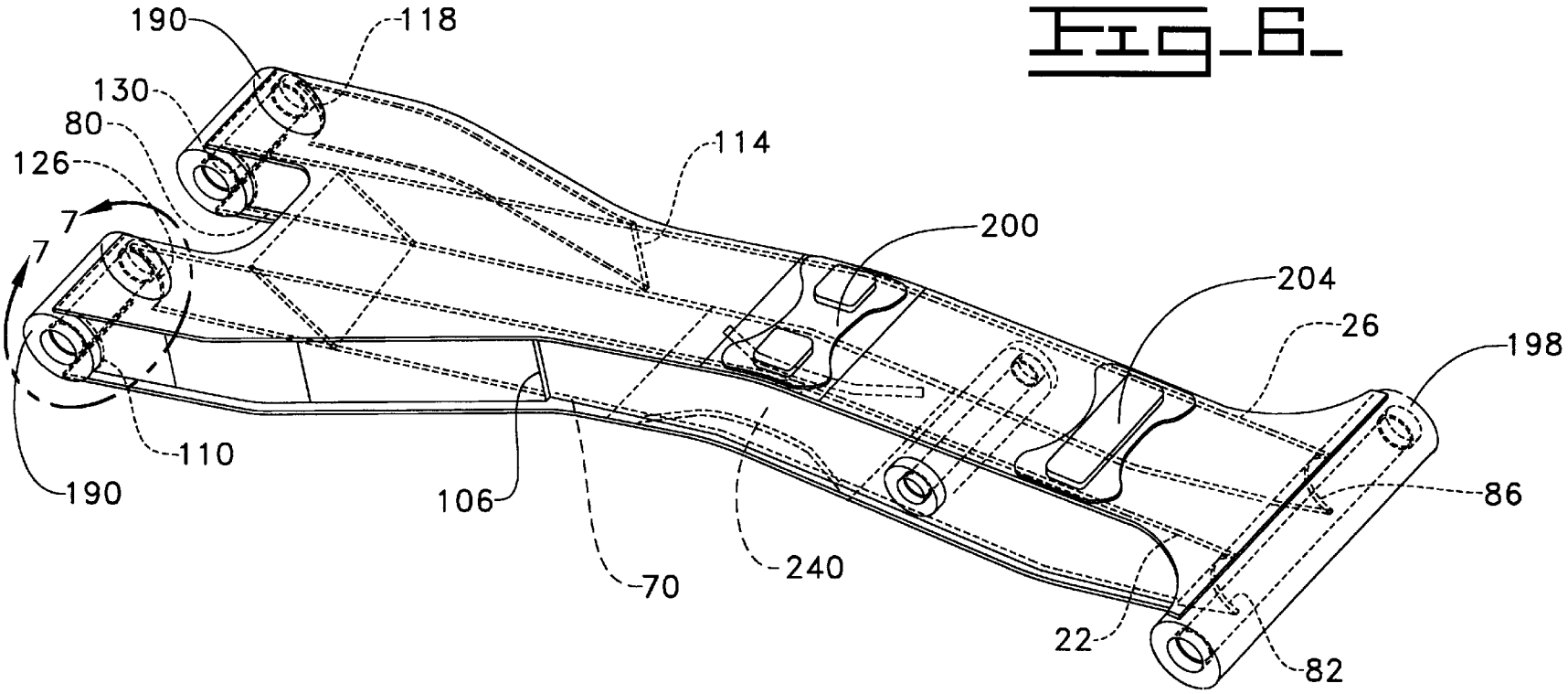
FIG. 6 is a perspective isometric view of the embodiment of the present invention.
Figure 8:
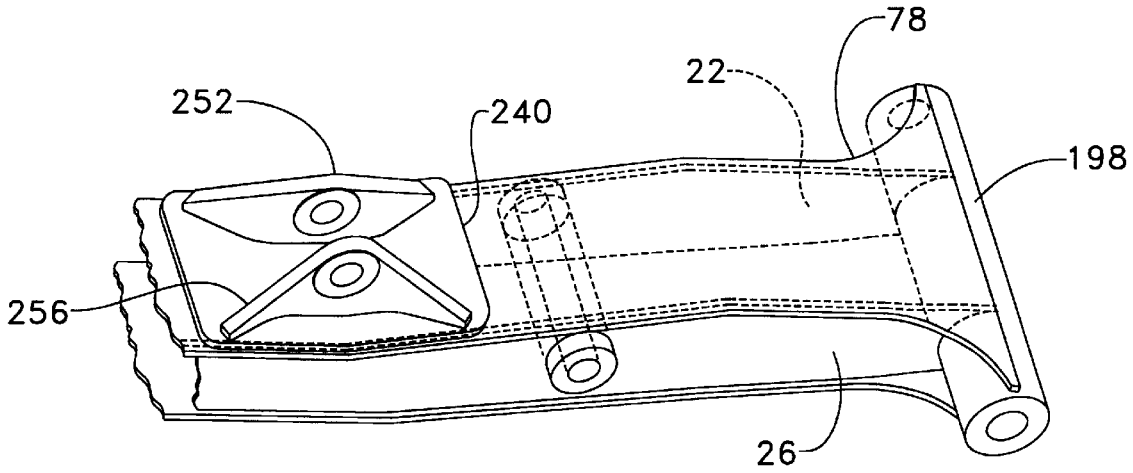
FIG. 8 is a perspective partial bottom view of the embodiment of the present invention.

The second ends 126,130 of the pair of inner side walls 22,26, respectively, and the second end 110,118 of the pair of outer side wall 94,98 have an inwardly extending semi-circular shape which define together a pair of contoured frame boss mounting surfaces 154,158 at a distal portion 162 of the legs 138,142. The first ends of the 82,86 of the pair of inner side walls 22,26, respectively, have an inwardly extending semi-circular shape which define a contoured coupler boss mounting surface 186. Each inner side wall 22,26 has a transitional width thereacross consisting of several point locations along the length. Referring more specifically to FIG. 5, the semi-circular first ends 82,86 of the pair of inner side walls 22,26 from point A to point B has an arc length of approximately five percent of the total box boom lift arm length, point B to point C has a length of approximately twenty to thirty percent of the total box boom lift arm length and is angled at approximately two degrees from a horizontal plane, point C to point D has a length of approximately twenty-five percent of the total box boom lift arm length and is angled at approximately ten degrees from a horizontal plane, point D to point E has a length of approximately forty-five to fifty-five percent of the total box boom lift arm length and is angled at approximately four degrees from a horizontal plane. The semi-circular second ends 126,130 of the pair of inner side walls 22,26 from point E to point F has an arc length of approximately five percent of the total box boom lift arm length, point F to point G has a length of approximately forty to sixty percent of the total box boom lift arm length and is angled at approximately five degrees from a horizontal plane, point G to point A has a length of approximately forty to fifty percent of the total box boom lift arm length and is angled at approximately seven degrees from a horizontal plane. Point C corresponds to the bend location and angle of the first plate member 54 of the bottom wall 50. Point G corresponds to the bend location and angle of the top wall 30.

It should be noted that all dimensions and references thereof are given for perspective purposes only and may vary dependent on the machine or circumstances in which the invention is used.

Figure 7:
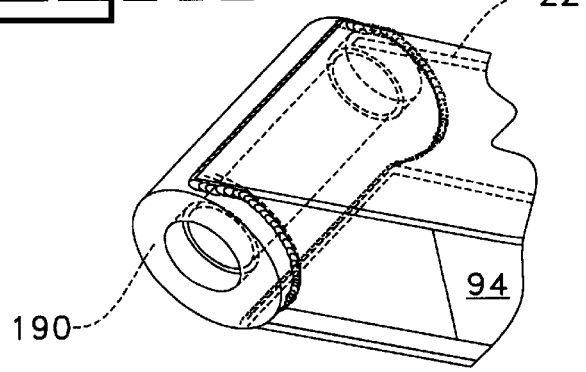
FIG. 7 is a enlarged perspective isometric view of the area in FIG. 6 encircled by 7—7.

As seen more clearly in FIG. 7, a frame pin boss 190 made from round steel stock or any other suitable material is disposed within each of the contoured frame boss mounting surfaces 154,158, respectively, and is fixedly connected to the legs 138,142 through a plurality of welds circumferentially extending substantially between the respective inner side wall 22,26 and outer side wall 94,98 and the top and bottom walls 30,50. A lower coupler pin boss 198 made from round steel stock or any other suitable material is disposed within the contoured coupler boss mounting surface 186 and is fixedly connected at the coupler end portion 88 through a plurality of welds circumferentially extending between the inner side walls 22,26 and the top and bottom walls 30,50.

Spaced rack and dump plates 200,204 are welded to a top surface 208 of the top wall 30. The rack plate 200 has a pair of spaced outward projections 212,216 and the dump plate 204 has a single outward projection 220, all of which are elevated above the top surface 208 of the top wall 30 to act as stop pads. The outward projection 220 of the dump plate 204 has a length which extends substantially across the dump plate 204 approximately equal to the total distance of the outward projections 212,216 of the rack stop 200. The outward projections 212,216,220 of the rack and dump plates 200,204 have a contact surface 228 and are located at separate predetermined locations, respectively, on the top surface 208. The rack and dump plates 200,204 are positioned in relation to a specified portion of a minimum and maximum lift operation range (not shown) respectively, corresponding to a predetermined angle of the bucket 14 and operatively associated with the linkage arrangement 16. It should be noted that the rack and dump plates 200,204 may be a single plate located in a distinct position along the top surface 208 of the top wall 30 and may be operatively associated with the linkage structure or any suitable surrounding structure. It should also be noted that the outward projections 212,216,220 of the rack and dump plates 200, 204, respectively, may include single or double stop pads or any combination thereof without diverting from the scope of the invention. A lift pin boss plate assembly 240 is welded substantially at the central portion 74 of the bottom wall 50 substantially at the connection between the first and second plate members 54,58 and has a length of approximately seventeen to twenty percent of the total box boom lift arm assembly length which extends along a portion of the length of the bottom wall 50. The lift pin boss plate assembly 240 includes a pair of outwardly extending walls 252,256. A lift cylinder 264 is pivotally connected through a pin (not shown) in a well know manner at a first end 268 to the box boom lift arm assembly 18 to define a pin joint 270 between the outwardly extending walls 252,256. A second end 272 of the lift cylinder 264 is pivotally connected to the frame (not shown). A tilt cylinder 276 is pivotally connected at a first end 280 to the linkage arrangement 16 and at a second end 284 to the frame (not shown). The lift cylinder 264 and tilt cylinder 276 work cooperatively to controllably position the bucket 14 to perform work operations through the connections to the respective box boom lift arm assembly 18 and linkage arrangement 16.

Industrial Applicability

The preferred method of manufacturing the disclosed embodiment of the box boom lift arm assembly 18 lends itself to a more uniform product with enhanced strength capabilities. First, the top wall plate 30 is cut to the predetermined length and formed along the bend path at location 32. Next, the first and second bottom wall plates 54,58 are cut to the predetermined length and the first bottom wall plate 54 is formed along the bend line at location 62. Then, the inner side wall plates 22,26 are cut to the predetermined length corresponding with the predetermined lengths of the formed top wall plate 30 and the combination of the formed first bottom wall plate 54 and second bottom wall plate 58. The transitional width from Points A–G, and in particular Points C and G, correspond to the configuration of the top and bottom wall plates 30,50 to provide the box section when assembled. Next, the pair of outer side wall plates 94,98 are cut to the predetermined length and are formed along the first bend path at locations 100.

One of the most important steps in manufacturing a welded structure such as the box boom lift arm assembly 18 is to maintain uniform welds and satisfactory manufacturing tolerances. Keeping that in mind, the next step involves positioning the plates 54,58 in a fixture (not shown). Then, welding the first bottom plate 54 to the second bottom plate 58 at the respective central portion 74 across the width thereof. Next, positioning the pair of inner side wall plates 22,26 in the spaced relationship in the fixture (not shown) and tack welding the pair of inner side wall plates 22,26 to the first and second bottom wall plates 54,58. Then, tack welding the frame pin bosses 190 and coupler pin boss 198 in their perspective locations on the respective one of the pair of inner side wall plates 22,26 and first and second bottom wall plates 54,58. Next, positioning the top wall plate 30 in the fixture (not shown) and tack welding it to the pair of inner side wall plates 22,26. Then, tack welding the closure plate 146 in position between the pair of inner side wall plates 22,26. Next, the lift pin boss plate assembly 240 and rack and dump plates 200,204 are tack welded to the box boom lift arm assembly at their perspective locations.

The final steps include welding the top and bottom wall plates 30,50 to the pair of inner side wall plates 22,26 in a non-transverse bead substantially along the entire length of the pair of inner side wall plates 22,26 in a well-known manner so as to relieve residual stresses during welding. Next, welding the frame pin bosses 190 substantially along the entire periphery of the respective legs 138,142 and welding the coupler pin boss 198 along the entire periphery of the coupler end portion 88. Then, welding the closure plate 146 in position to substantially enclose the box boom lift arm assembly 18. Next, positioning the pair of outer side wall plates 94,98 at the outer portion 122 of the top wall plate 30 and second bottom wall plate 58 and therebetween so that the first end of each of the pair of outer side wall plates 94,98 abuts with a respective inner side wall plate 22,26. Then, tack welding the pair of outer side wall plates 94,98 to the respective inner side wall plate 22,26, the top and bottom wall plates 30,50 and the respective frame pin boss 190. Next, welding the top and bottom wall plates 30,50 to the pair of outer side wall plates 94,98 in a continuous non-transverse bead substantially along the entire length of the pair of outer side wall plates 94,98 and welding the pair of inner side wall plates 22,26 to the outer side wall plates 94,98. Then, welding the respective frame pin boss 190 to the pair of outer side wall plates 94,98 completely along the entire periphery of the respective legs 138,142. Next, welding the lift pin boss plate assembly 240 and rack and dump plates 200,204 to the box boom lift arm assembly 18.

It should be understood that the finish welding of the frame pin bosses 190, the coupler pin boss 198 and the closure plate 146 to the box boom lift arm assembly 18 provides a means for enclosing the box section and prevents subsequent entry of external matter, such as dirt and water.

It is well known that the loads and forces on the box boom lift arm assembly 18 can be extremely severe dependent on various factors of operation. Therefore, the increased strength and loading capabilities derived from the component configurations and enhanced manufacturing techniques are imperative. For example, the simple construction of the box boom lift arm assembly 18 fabricated from plate steel and round steel stock creates the rectangular cross section which is maintained throughout the entire box boom lift arm assembly 18 length, varying only in height and width. Furthermore, the manufacture of the box boom lift arm assembly 18 from a completely welded fabrication of plate steel and round steel stock substantially eliminates transverse weld joints which improves its fatigue characteristics by creating a straight load path from one end of the box boom lift arm assembly 18 to the other. The sectional property of the box boom lift arm assembly 18 also provides a lower weight to strength performance ratio. The increased width of the bifurcated end portion 134 is designed to spread box boom lift arm assembly 18 loads which increase torsional and lateral stiffness. The increased width of the coupler end portion 88 to substantially twice the width of the central portion thereof also serves to improve the mechanical strength of the box boom lift arm assembly 18. The locally increased width and smooth transition of the coupler end portion 88 near the end of the box boom lift arm assembly 18 provides a better path for load transfer from the bucket 14 or tool to the box boom lift arm assembly 18 and surrounding linkage structure. The positioning of the rack and dump stops 200,204 on the top surface 208 of the top wall provides a large footprint with an increased area to achieve a greater distribution of loading during maximum and minimum lifting. The lift cylinder 264 is connected to the bottom wall of the box boom lift arm assembly 18 through the lift pin boss plate assembly 240 for a larger footprint and better distribution of lift cylinder forces.

Other aspects, objects and advantages of this invention can be obtained from a study of the drawings, disclosure and the appended claims.

We claim:

1. A box boom lift arm assembly for a construction machine, comprising:

top and bottom walls extending a predetermined length, each of the top and bottom walls having a central portion with a predetermined width, a first end portion diverging outwardly from the central portion and terminating at a predetermined width greater than the predetermined width of the central portion and a bifurcated second end portion diverging outwardly in a substantial U-shape from the central portion opposite the first end portion and terminating at a predetermined width greater than the predetermined width of the central portion;

a pair of inner side walls having a predetermined length substantially equal to the length of the top and bottom walls, each of the pair of inner side walls having first and second ends and being disposed between the top and bottom walls and fixedly connected thereto substantially along the entire predetermined length of the inner side walls, the first ends of the inner side walls defining with the first end portions of the top and bottom walls a diverging end portion; and a pair of outer side walls having a predetermined length, each of the pair of outer side walls having first and second ends and being fixedly connected at the first end to one of the pair of inner side walls at a predetermined location along the predetermined length of the inner side walls and disposed between the U-shape second end portion of the top and bottom walls and fixedly connected thereto, the second ends of the outer side walls defining with the second ends of the inner side walls and the second end portions of the top and bottom walls a bifurcated end portion having a pair of legs.

2. The box boom lift arm assembly of claim 1, wherein the pair of inner side walls and top wall are fixedly connected through a continuous non-transverse weld, the pair of inner side walls and the bottom wall are fixedly connected through a continuous substantially non-transverse weld and the pair of outer side walls and top and bottom walls are fixedly connected through a continuous non-transverse weld extending substantially along the predetermined length of the outer side walls.

3. The box boom lift arm assembly of claim 1, wherein the first end portions of the top and bottom walls are non-bifurcated and each includes a planar edge wherein the predetermined width is continuous and non-interrupted.

4. The box boom lift arm assembly of claim 2, wherein the bottom wall is made from first and second plates fixedly connected through a continuous transverse weld extending substantially across the predetermined width of the central portion of the bottom wall and the top wall is made from a single plate.

5. The box boom lift arm assembly of claim 4, wherein the top wall plate is formed along a first bend path at a predetermined location and angle and the first plate of the bottom wall is formed at a predetermined location and angle so that the top wall plate and bottom wall plate achieve the substantially predetermined equal length with the inner side wall plates.

6. The box boom lift arm assembly of claim 5, wherein each of the pair of inner side walls is a single flat plate having a transitional width at predetermined locations along the predetermined length thereof corresponding to the respective bends in the single plate of the top wall and the first plate of the bottom wall.

7. The box boom lift arm assembly of claim 1, including the first and second ends of the pair of inner side walls and the second end of the pair of outer side walls having a semi-circular shape, a pair of frame pin bosses disposed within the semi-circular second ends of the inner side walls and the second ends of the outer side walls and extending therebetween with each one of the pair of frame pin bosses being fixedly connected therealong to one of the pairs of legs and a coupler pin boss disposed within the semi-circular first ends of the pair of inner side walls and extending along the predetermined width of the diverging end portion and being fixedly connected therealong.

8. The box boom lift arm assembly of claim 1, including a closure plate fixedly connected to the pair of inner side wall plates and the top and bottom plates between the pair of legs to enclose the box boom lift arm assembly.

9. The box boom lift arm assembly of claim 1, wherein rack and dump stops are positioned at least one predetermined location on an outer surface of the top wall, the rack and dump stops including an outward projection having a contact surface elevated above the outer surface of the top wall.

10. The box boom lift arm assembly of claim 1, wherein spaced rack and dump stops are positioned at predetermined locations on an outer surface of the top wall, the rack and dump stops each including an outward projection having a contact surface elevated above the outer surface of the top wall.

11. The box boom lift arm assembly of claim 10, wherein the rack and dump stops are connected to a respective plate welded to the top surface of the top wall.

12. The box boom lift arm assembly of claim 1, including a lift pin boss plate assembly welded substantially at the central portion of the bottom wall and extending a predetermined length along the predetermined length of the bottom wall.

* * * * *